US010578302B2

(12) United States Patent
Santinanavat et al.

(10) Patent No.: US 10,578,302 B2
(45) Date of Patent: Mar. 3, 2020

(54) APPARATUS AND METHODS FOR ARRESTING FLAME AT A GAS BURNER

(71) Applicant: Emerson Electric Co., St. Louis, MO (US)

(72) Inventors: Mike C. Santinanavat, Chesterfield, MO (US); John Kopp, Waterloo, IL (US); Christina M. Gillam, St. Louis, MO (US)

(73) Assignee: EMERSON ELECTRIC CO., St. Louis, MO (US)

( * ) Notice: Subject to any disclaimer, the term of this patent is extended or adjusted under 35 U.S.C. 154(b) by 528 days.

(21) Appl. No.: 15/068,730

(22) Filed: Mar. 14, 2016

(65) Prior Publication Data

US 2016/0290636 A1 Oct. 6, 2016

Related U.S. Application Data

(60) Provisional application No. 62/140,368, filed on Mar. 30, 2015.

(51) Int. Cl.

| | |
|---|---|
| ***F23D 14/58*** | (2006.01) |
| ***F23D 14/82*** | (2006.01) |
| ***F24H 9/18*** | (2006.01) |
| ***F23D 14/06*** | (2006.01) |

(52) U.S. Cl.

CPC ..... *F23D 14/82* (2013.01); *F23D 14/06* (2013.01); *F23D 14/58* (2013.01); *F24H 9/1836* (2013.01)

(58) Field of Classification Search

USPC ..... 431/346

See application file for complete search history.

(56) References Cited

U.S. PATENT DOCUMENTS

| | | | | |
|---|---|---|---|---|
| 2,610,676 | A * | 9/1952 | Wheelock | 239/424 |
| 2,627,910 | A * | 2/1953 | Abrams | F23D 14/04 239/552 |
| 3,021,893 | A * | 2/1962 | Honger | F23D 14/145 431/329 |
| 3,202,204 | A * | 8/1965 | Jouard | F23C 99/00 239/145 |
| 3,748,111 | A * | 7/1973 | Klose | A62C 4/00 220/88.2 |
| 3,870,031 | A * | 3/1975 | Kruper | A47J 37/06 126/39 J |
| 4,427,367 | A * | 1/1984 | Yagisawa | F23D 11/40 239/113 |
| 6,295,952 | B1 * | 10/2001 | Reynolds | F24H 9/1836 122/14.31 |
| 2012/0178031 | A1 * | 7/2012 | Roy | F23D 14/62 431/12 |
| 2013/0164699 | A1 | 6/2013 | Bettinzoli | |
| 2014/0345541 | A1 | 11/2014 | Neumeier et al. | |

* cited by examiner

*Primary Examiner* — Avinash A Savani

(74) *Attorney, Agent, or Firm* — Harness, Dickey & Pierce, P.L.C.; Anthony G. Fussner

(57) ABSTRACT

Disclosed are exemplary embodiments of apparatus and methods for arresting flame at a gas burner. In an exemplary embodiment, an apparatus for use in burning a gas fuel generally includes a flame arrester device having a screen portion configured for placement between a gas orifice and a burner. The flame arrester device is configured to allow gas emitted from the gas orifice to pass through the screen portion to enter the burner. The flame arrester device is further configured to arrest a flame from the burner before the flame reaches the gas orifice.

20 Claims, 4 Drawing Sheets

APPARATUS AND METHODS FOR ARRESTING FLAME AT A GAS BURNER

CROSS-REFERENCE TO RELATED APPLICATION

This application claims the benefit of U.S. Provisional Application No. 62/140,368, filed on Mar. 30, 2015. The entire disclosure of the above application is incorporated herein by reference.

FIELD

The present disclosure generally relates to apparatus and methods for arresting flame at a gas burner.

BACKGROUND

This section provides background information related to the present disclosure which is not necessarily prior art.

In a gas-fired storage water heater, a flame for heating the water is produced in the presence of three elements: a flammable substance (gas), air, and heat. The air is from the atmosphere and the heat may initially be provided, e.g., by an igniter system of the heater. A gas burner acts to heat the water in a tank. Gas-fired water heaters can typically be used with three different types of supply gas: natural gas (having a low specific gravity), propane and natural gas/butane mix (having a high specific gravity). Higher specific gravity gases tend to move at lower velocities than lower specific gravity gases.

SUMMARY

This section provides a general summary of the disclosure, and is not a comprehensive disclosure of its full scope or all of its features.

According to various aspects, exemplary embodiments are disclosed of apparatus and methods for arresting flame at a gas burner. In an exemplary embodiment, an apparatus for use in burning a gas fuel generally includes a flame arrester device having a screen portion configured for placement between a gas orifice and a burner. The flame arrester device is configured to allow gas emitted from the gas orifice to pass through the screen portion to enter the burner. The flame arrester device is further configured to arrest a flame from the burner before the flame reaches the gas orifice.

In another example embodiment, gas burner assembly for a water heater generally includes a gas burner having a gas/air inlet, and a burner tube configured for connection with a gas control valve. The burner tube has a gas metering orifice configured to emit gas toward the gas/air inlet of the burner. The gas burner assembly also includes a flame arrester device between the gas metering orifice of the burner tube and the gas/air inlet of the burner. The flame arrester device has a screen portion for allowing gas from the gas metering orifice to pass through the screen portion to enter the gas/air inlet of the burner. The screen portion is further configured to prevent a flame from the burner from flashing back to the gas orifice.

In one example implementation, the disclosure is directed to a method of making a gas burner assembly. The example method includes connecting a bracket between a burner tube and a gas burner so as to allow air flow toward the burner. The method also includes installing a flame arrester device at a gas/air inlet of the burner, the installing including positioning a screen portion of the flame arrester device to at least partly cover the gas/air inlet.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The inventor hereof has recognized that millivolt mechanical systems have generated interest because of their comparatively low energy requirements. Millivolt systems tend to work best with servo regulating control valves. Such valves, however, can have longer gas shutoff times than direct-acting regulating gas control valves. In some situations when a gas valve is shut off, if the gas is not stopped fast enough, the flame from a burner may chase the fuel supply through the burner and back to an orifice supplying the gas to the burner.

Accordingly, the inventors have developed and disclose herein exemplary embodiments of apparatus and methods for arresting flame at a gas burner, including embodiments of a flame arrester for a main burner in a water heater. In one example embodiment, a flame arrester is provided for a pancake burner in a gas fired storage water heater.

Figure 1:
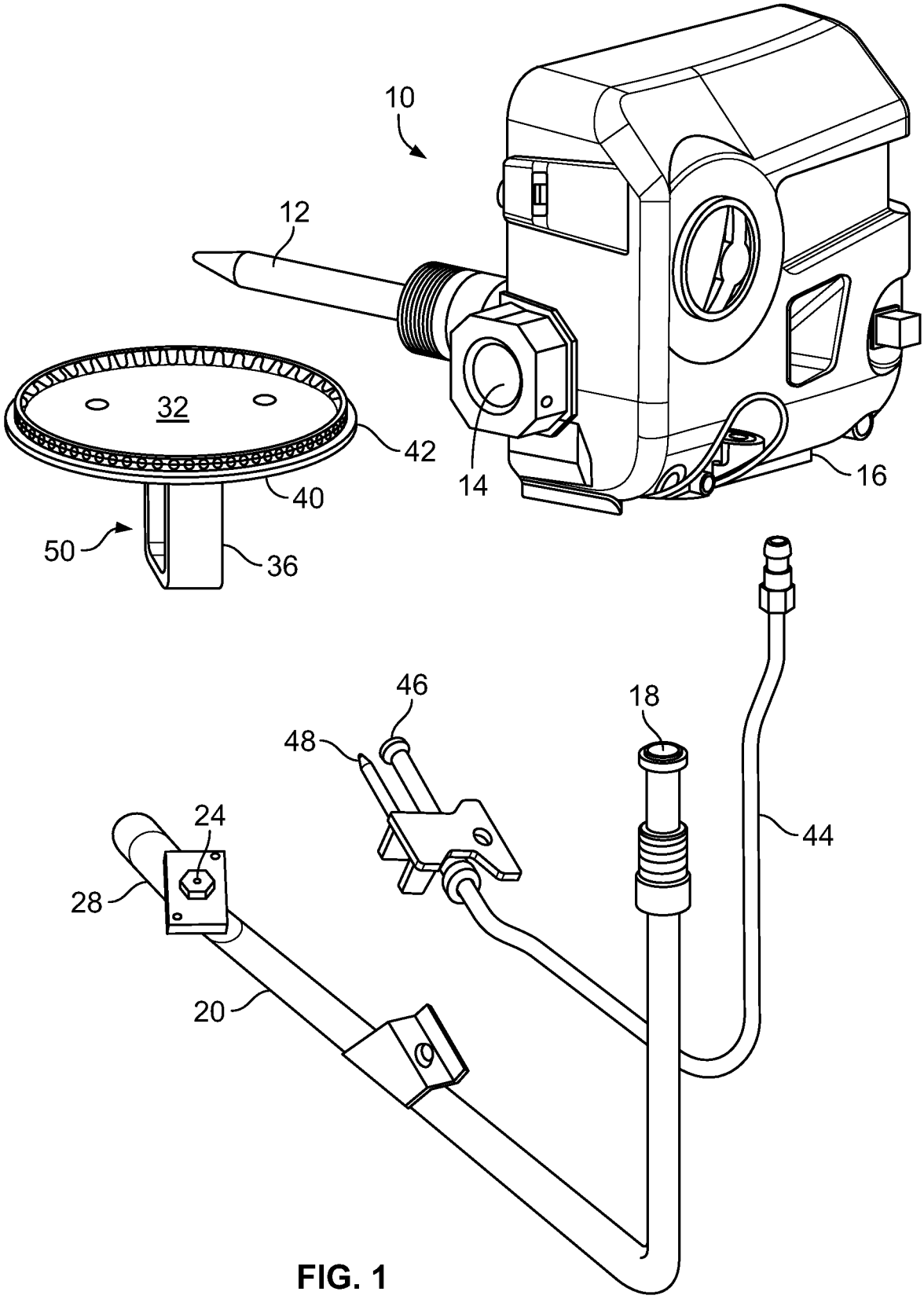
FIG. 1 is an exploded perspective view of various exemplary gas-fired storage water heater components in accordance with one example embodiment of the disclosure.

With reference now to the figures, FIG. 1 is an exploded perspective view of various exemplary gas-fired storage water heater components embodying one or more aspects of the present disclosure. As shown in FIG. 1, components of a gas-fired storage water heater include a gas control 10 configured for connection to a water tank (not shown.) The gas control 10 includes a temperature probe 12 for sensing water temperature inside the tank. The control 10 also includes a gas inlet 14 and a safety control valve 16 to which one end 18 of a main burner tube 20 is connected. A gas control orifice 24, also called a metering orifice, is mounted in the other end 28 of the main burner tube 20. A main burner 32 is mounted at the end 28 of the main burner tube 20, above the orifice 24, e.g., by a bracket 36 welded at the end 28 of the tube 20. In the present example embodiment, the burner 32 is, e.g., a "pancake" burner, although embodiments are possible in relation to other types of burners. In the present example embodiment, the gas control orifice 24 is located about two (2) to three (3) inches from the underside 40 of the main burner 32 and is coaxial with the main burner 32. An igniter system 44 also is connected to the gas control 10 and includes a thermocouple 46 and an igniter 48.

An example embodiment of a flame arrester device 50 (the general location of which is indicated in FIG. 1 by reference number 50) is provided between the main burner 32 and the gas control orifice 24. The example flame arrester device 50 is shown in greater detail in FIGS. 2-3. The flame arrester device 50 is provided, e.g., on the underside 40 of the main burner 32 and includes a screen portion 52. The gas control orifice 24 is oriented toward a gas/air inlet 54 of the main burner 32. The example flame arrester device 50 is installed, e.g., between the gas control orifice 24 and the gas/air inlet 54. In the present example embodiment, the flame arrester device 50 completely covers the gas/air inlet 54. For example, the flame arrester device 50 extends across the gas/air inlet 54 and contacts and extends past an edge 56 of the gas/air inlet 54. In the present example embodiment, edges 58 of the flame arrester device 50 are welded or otherwise attached to opposed arms 60 of the bracket 36. In various embodiments, a bracket may be provided for use with a burner, where the bracket includes a flame arrester device as a component. In various embodiments, a flame arrester device may be provided as a burner component that is welded or otherwise directly fastened to an edge of a burner gas/air inlet. Embodiments also are possible in which a burner gas/air inlet is partially covered by a flame arrester device.

Figure 2:
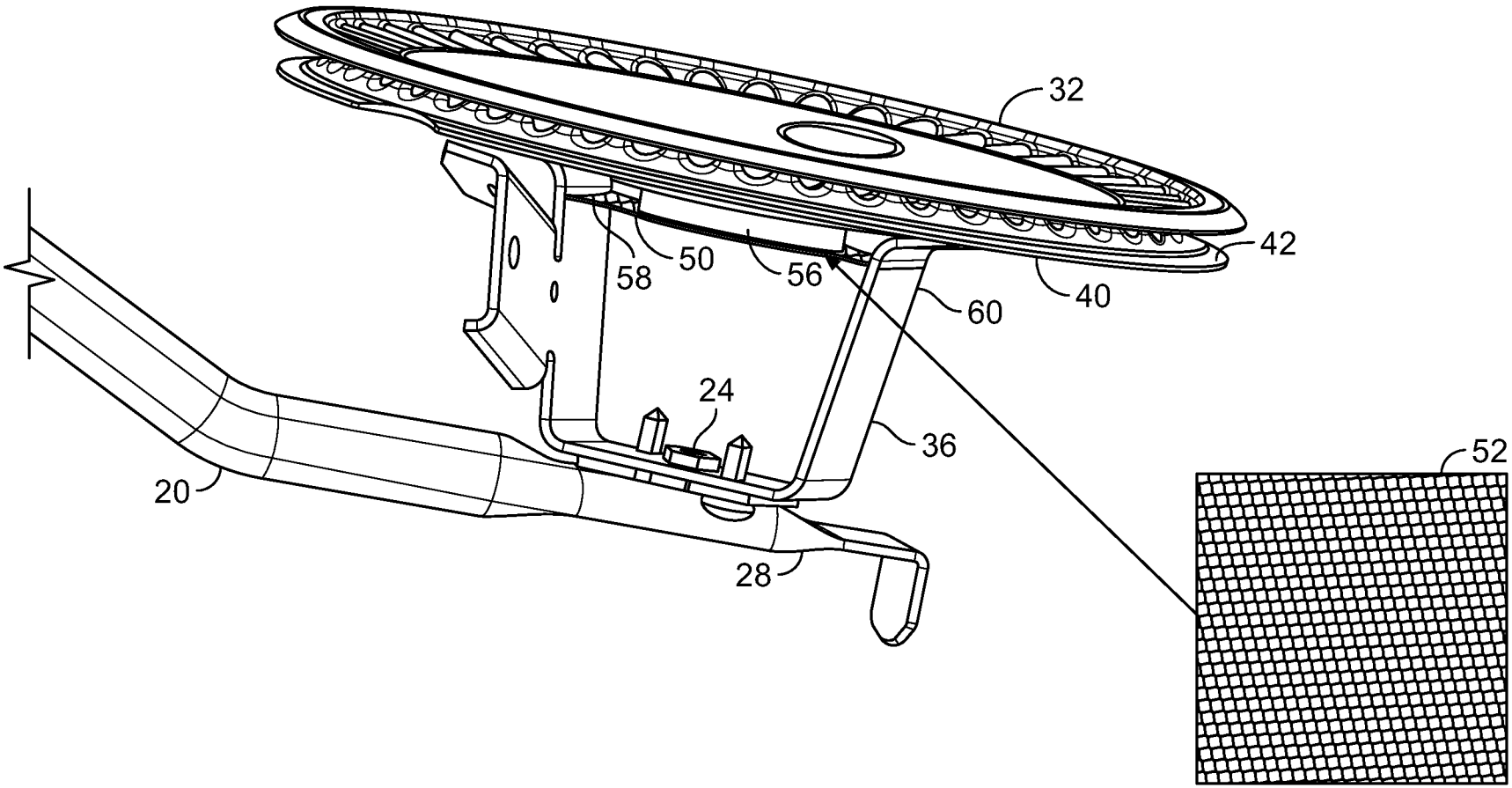
FIG. 2 is a side perspective view of a gas burner assembly including a flame arrester device in accordance with one example embodiment of the disclosure, a bottom view of the flame arrester device also being shown.
Figure 3:
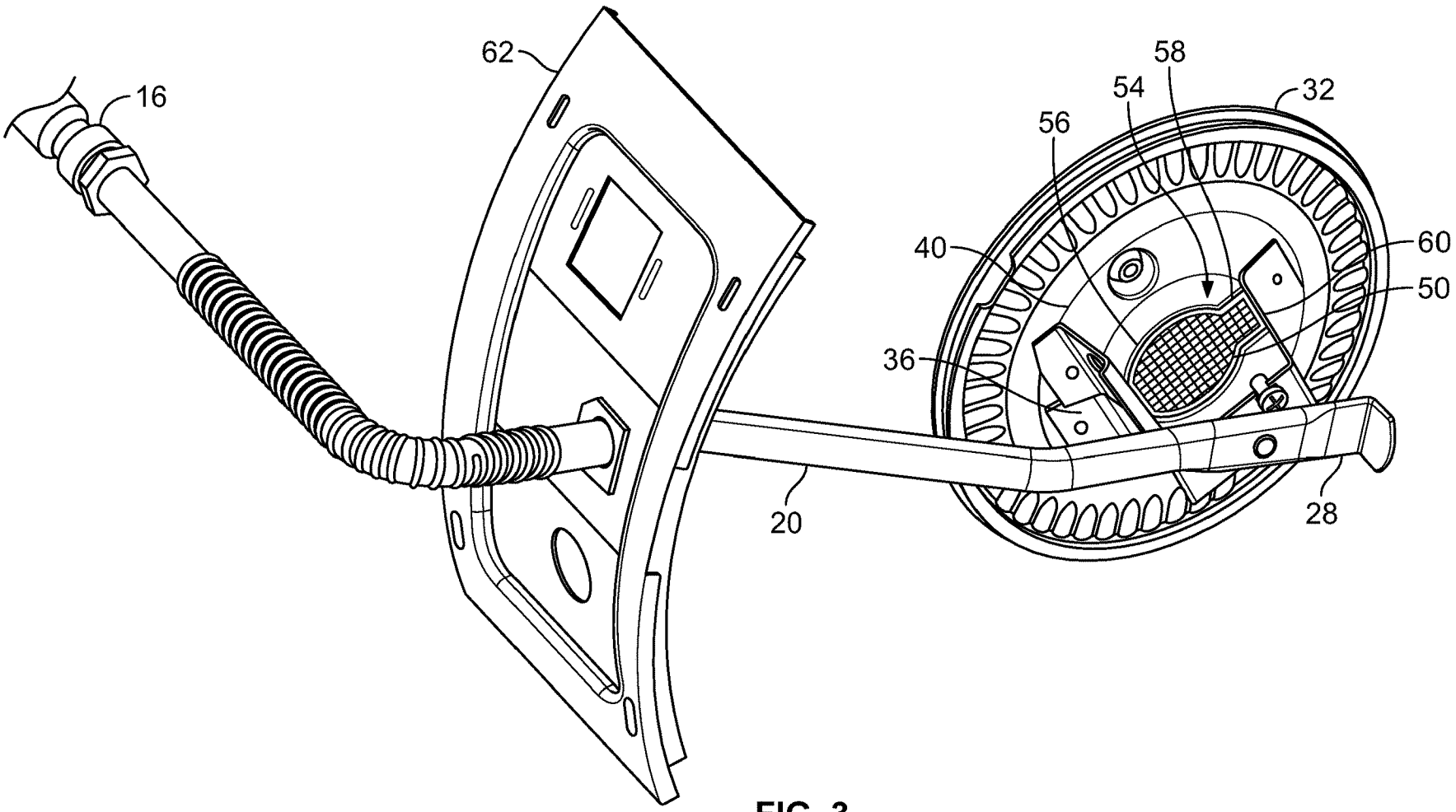
FIG. 3 is a bottom perspective view of a gas burner assembly including a flame arrester device in accordance with one example embodiment of the disclosure.

In the present example embodiment, and as shown in FIGS. 2-3, the screen portion 52 of the flame arrester device 50 is a mesh screen, e.g., a standard US number 6 (0.132-inch) mesh stainless steel screen, mounted over the gas/air inlet 54 to the main burner 32. As shown in FIG. 3, the main burner tube 20 extends through a door or cover 62 attachable to the water tank to cover an opening for accommodating the tube 20 and the main burner 32 in the tank. The mesh of the flame arrester device 50 is configured to allow gas flow through the gas/air inlet 54 to the main burner 32 so as to not disrupt the flame during operation of the water heater.

Figure 4:
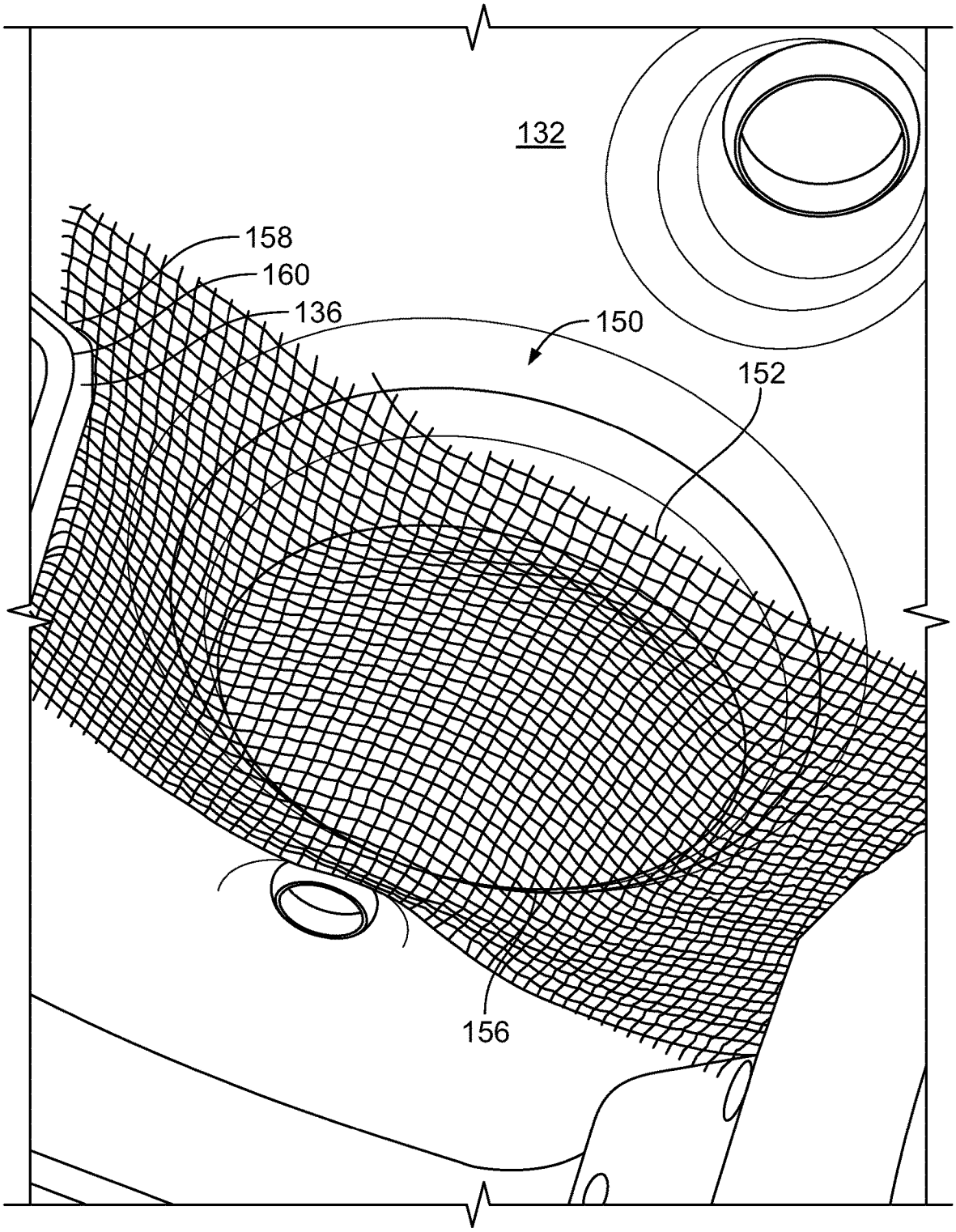
FIG. 4 is a bottom perspective view of a flame arrester device mounted over a gas/air inlet of a burner in accordance with one example embodiment of the disclosure.

Another example embodiment of a flame arrester device is indicated generally in FIG. 4 by reference number 150. The flame arrester device 150 includes a screen portion 152 having an edge 158 that is fastened between a burner 132 and an arm 160 of a bracket 136 In the example flame arrester device 150, edges 158 are extensions of the screen portion 152. In some other embodiments, a flame arrester device may have one or more edges having a configuration different from screen and/or made of alternative or additional material(s). Other or additional ways could be utilized to affix a flame arrester device to a burner and/or bracket.

It should be noted that other or additional arrester materials, meshes, material patterns, textures, shapes, openings, mesh densities, mesh sizes, weights, thicknesses, etc. could be used in other or additional embodiments, to appropriately accommodate flame and also provide appropriate flame disruption as discussed below. Additionally or alternatively and in various embodiments, a flame arrester device could be mounted in various ways and locations relative to a burner so as to allow gas flow to the burner without disrupting the flame during operation and still disrupt a flame, as further described below, when gas flow to the burner is turned off.

During operation of the burner 32 to heat water in the tank, gas is fed to the burner 32 through the safety control valve 16, through the main burner tube 20, and through the gas control orifice 24. The safety control valve 16 detects the temperature of the water in the tank and shuts off the gas flow to the main burner 32 when a call for heat is satisfied. When the safety control valve 16 shuts off the gas flow to the main burner 32, gas still inside the main burner tube 20 moves to burn off at the main burner 32. If no flame arresting mechanism is provided, and if enough gas (residual gas) remains in the burner tube 20 to support a flame or if the gas in the tube 20 moves slowly, the flame could possibly propagate back to the gas control orifice 24. This might occur, e.g., when the operational outlet pressure from the gas valve is low. Such a flashback might damage the gas control tube assembly and reduce the life of the main burner 32.

The flame arrester device 50 is configured to disrupt a flame, e.g., that otherwise might occur due to residual and/or slow-moving gas when the safety control valve 16 shuts off the gas flow to the main burner 32. The flame arrester 50 is configured to stop fuel combustion by extinguishing the flame and/or by disrupting the flame pattern such that the flame does not flash back to the orifice 24 while the gas is being burned off. The life of the main burner 32 can thereby be extended. The flame arrester device 50 thus is configured to prevent flame flashback while allowing gas flow from the orifice 24 to the burner 32.

One example implementation of a method of making a gas burner assembly includes connecting a bracket between a burner tube and a gas burner so as to allow air flow toward the burner. The method also includes installing a flame arrester device at a gas/air inlet of the burner, which includes positioning a screen portion of the flame arrester device to at least partly cover the gas/air inlet. In some embodiments, installing the flame arrester device includes connecting the screen portion to at least a portion of an edge of the gas/air inlet of the burner. In some other embodiments, the screen portion is positioned to at least partly cover the gas/air inlet, e.g., without being fastened to the edge of the gas/air inlet. In some embodiments the screen portion may be stretched over the gas/air inlet of a burner. In some implementations, installing the flame arrester device includes fastening an edge of the flame arrester device to an arm of the bracket, e.g., as shown in FIG. 2. In some other implementations and as shown in FIG. 4, installing the flame arrester device includes affixing an edge of the flame arrester device between the burner and an arm of the bracket, e.g., as the bracket is being connected to the burner.

Embodiments of the foregoing flame arrester device are contemplated for use in relation to valves operating on millivolt current sources. In some low power valves, the spring force used to close the valves can be quite low, so that their closing times can tend to be longer than in those gas valves having more available energy to overcome a higher spring force, e.g., in some valves that are electrically powered, e.g., by 120 VAC, or in some valves using heat energy, such as in some mechanical controls. Various embodiments, however, are applicable in relation to substantially any valve used, e.g., on a water heater. Furthermore, embodiments are not limited to applications in relation to water heaters.

Embodiments of the foregoing flame arrester device can prevent flashback to a gas control orifice and also can provide various advantages compared to conventional arrester devices. For example, embodiments of the foregoing flame arrester device are not typically influenced as much as some conventional arrester devices by main burner temperature or gas velocity. Various embodiments allow for greater gas capacity of a safety control valve, can allow for a greater range of pressure regulation for safety control valves, and/or allow for longer burner tube lengths. Embodiments of the foregoing flame arrester device can be cost effective and easy to install. Embodiments of the foregoing flame arrester device can be used in relation to millivolt systems with servo systems, and also in relation to pilot burner systems with or without flame propagation springs. Embodiments are possible in relation to gas control and other applications involving position identification via mechanical and/or electronic means.

Embodiments of the foregoing flame arrester device are in contrast to conventional methods using a direct-acting regulation safety control valve, volume reduction from the shutoff valve to the main burner, and/or faster closing speeds of the shutoff valve to the main burner. Such solutions can require extremely fast gas shut off, e.g., at 1 to 2 inches W.C. pressure of butane gas or a butane/air mixture. Some conventional flame arresting methods have limited the choice of a safety control valve to one using direct-acting regulation instead of servo regulation. Servo regulation safety control valves can allow for a greater range of use for different size heaters and more precise gas pressure supply to a main burner. Conventional methods have involved reducing the gas capacity of a safety control valve, thus reducing the heater size that it can be used on. Various conventional quick shutoff methods may only work at certain conditions depending on the gas velocity and temperature of the burner.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Or, for example, the term "about" as used herein when modifying a quantity of an ingredient or reactant of the invention or employed refers to variation in the numerical quantity that can happen through typical measuring and handling procedures used, for example, when making concentrates or solutions in the real world through inadvertent error in these procedures; through differences in the manufacture, source, or purity of the ingredients employed to make the compositions or carry out the methods; and the like. The term "about" also encompasses amounts that differ due to different equilibrium conditions for a composition resulting from a particular initial mixture. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A pancake burner assembly comprising:

a pancake burner having an inlet;

a burner tube configured to emit gas toward the inlet of the pancake burner;

a flame arrester device having a screen portion configured for placement at the inlet of the pancake burner and between the burner tube and the pancake burner, the flame arrester device configured to allow gas emitted from the burner tube toward the screen portion to pass through the screen portion to enter the pancake burner via the inlet of the pancake burner; and the flame arrester device further configured to arrest a flame from the pancake burner by stopping combustion at the inlet of the pancake burner at the screen portion before the flame reaches the burner tube, whereby flashback of the flame from the pancake burner is prevented.

2. The pancake burner assembly of claim 1, wherein the screen portion comprises a mesh configured to cover at least part of the inlet of the pancake burner.

3. The pancake burner assembly of claim 1, wherein the screen portion comprises a stainless steel mesh.

4. The pancake burner assembly of claim 1, wherein the screen portion comprises a 0.132-inch mesh.

5. The pancake burner assembly of claim 1, further comprising a bracket for mounting the pancake burner thereon, the flame arrester device connected with the bracket.

6. The pancake burner assembly of claim 1, wherein the screen portion is attached to at least a portion of an edge of the inlet of the pancake burner.

7. A water heater comprising the pancake burner assembly of claim 1.

8. The pancake burner assembly of claim 1, wherein the flame arrester device comprises an edge configured for attachment to a bracket supporting the pancake burner.

9. A gas pancake burner assembly for a water heater, the assembly comprising a pancake burner for a gas water heater having a gas/air inlet;

a burner tube configured for connection with a gas control valve, the burner tube having a gas metering orifice configured to emit gas toward the gas/air inlet of the pancake burner;

a flame arrester device configured at the gas/air inlet of the pancake burner and between the gas metering orifice of the burner tube and the gas/air inlet of the pancake burner, the flame arrester device having a screen portion configured in the flame arrester device for allowing gas from the gas metering orifice to pass through the screen portion to enter the gas/air inlet of the pancake burner; and the screen portion further configured to prevent a flame from the pancake burner from flashing back to the gas metering orifice by stopping combustion at the gas/air inlet of the pancake burner at the screen portion.

10. The gas burner assembly of claim 9, wherein the screen portion comprises a stainless steel mesh.

11. The gas burner assembly of claim 9, wherein the screen portion comprises a 0.132-inch mesh.

12. The gas burner assembly of claim 9, further comprising a bracket connected between the burner tube and the gas water heater pancake burner, such that the bracket connects the burner tube and the gas water heater pancake burner, and holding an edge of the flame arrester device.

13. The gas burner assembly of claim 9, wherein the screen portion is attached to at least a portion of an edge of the gas/air inlet of the pancake burner.

14. The gas burner assembly of claim 9, wherein the screen portion comprises a mesh configured to cover at least part of the gas/air inlet of pancake burner.

15. A water heater comprising the gas pancake burner assembly of claim 9.

16. A method of making a gas pancake burner assembly, the method comprising:

connecting a bracket between a burner tube and a gas pancake burner, such that the bracket connects the burner tube and the gas pancake burner, so as to allow air flow toward a gas/air inlet of the gas pancake burner; and installing a flame arrester device at the gas/air inlet of the gas pancake burner and between the gas/air inlet of the gas pancake burner and the burner tube, the installing including positioning a screen portion of the flame arrester device to at least partly cover the gas/air inlet, so as to allow the air flow toward the gas/air inlet to pass through at least part of the screen portion of the flame arrester device and so as to stop combustion at the screen portion at the screen portion before the flame reaches the burner tube, thereby preventing flashback of a flame from the gas pancake burner.

17. The method of claim 16, wherein the gas pancake burner is a water heater burner including the gas/air inlet, and wherein installing the flame arrester device comprises connecting the screen portion to at least a portion of an edge of the gas/air inlet of the water heater burner.

18. The method of claim 16, wherein installing the flame arrester device comprises fastening an edge of the flame arrester device to an arm of the bracket.

19. The method of claim 16, wherein the gas pancake burner is a water heater burner, and wherein installing the flame arrester device comprises affixing an edge of the flame arrester device between the water heater burner and an arm of the bracket.

20. The pancake burner assembly of claim 1, wherein:

the pancake burner is a water heater pancake burner including the inlet;

the flame arrester device is configured for placement between the burner tube and the inlet of the water heater pancake burner, such that the flame arrester device is configured for placement in a position coaxial to the inlet of the water heater pancake burner; and the gas orifice is coaxial to the inlet of the water heater pancake burner.

* * * * *